United States Patent [19]

Trainor et al.

[11] Patent Number: 4,959,690

[45] Date of Patent: Sep. 25, 1990

[54] PADDLE WHEEL CROSS-MIXER

[75] Inventors: John W. Trainor, Vestal; Bruce E. Holtje, Castle Creek, both of N.Y.

[73] Assignee: Imagitek, Inc., Binghamton, N.Y.

[21] Appl. No.: 307,317

[22] Filed: Feb. 6, 1989

[51] Int. Cl.[5] ..... G03G 15/08

[52] U.S. Cl. ..... 355/245; 366/329

[58] Field of Search ..... 355/245, 251, 253, 203; 118/653, 657, 658; 366/325, 327, 329

[56] References Cited

U.S. PATENT DOCUMENTS

| | | | |
|---|---|---|---|
| 3,707,947 | 1/1973 | Reichart, Jr. | 118/637 |
| 3,987,756 | 10/1976 | Katayama et al. | 355/245 X |
| 3,995,590 | 12/1976 | Volkers | 118/658 |
| 4,033,294 | 7/1977 | Charland et al. | 118/658 |
| 4,095,883 | 6/1978 | Parker et al. | 355/3 DD |
| 4,286,544 | 9/1981 | Witte | 118/657 |
| 4,344,692 | 8/1982 | Oda | 355/3 DD |
| 4,361,109 | 11/1982 | Mayer et al. | 118/655 |
| 4,559,898 | 12/1985 | Fukuchi et al. | 118/658 X |
| 4,570,570 | 2/1986 | Masham | 118/612 |
| 4,721,982 | 1/1988 | Ueda | 118/653 X |
| 4,855,783 | 8/1989 | Takashima et al. | 118/658 X |

FOREIGN PATENT DOCUMENTS

| | | | |
|---|---|---|---|
| 57-8563 | 1/1982 | Japan | 355/245 |
| 58-100165 | 6/1983 | Japan | 355/253 |
| 59-206850 | 11/1984 | Japan | 355/253 |
| 60-239780 | 11/1985 | Japan | 355/203 |

*Primary Examiner*—Joan H. Pendegrass

*Attorney, Agent, or Firm*—Kane, Dalsimer, Sullivan, Kurucz, Levy, Eisele and Richard

[57] ABSTRACT

This invention relates to a cross-mixer for a developer system of a photocopier, particularly one with a two component development system, which mixes the developer mixture (1) to assure uniform lateral distribution of the toner, (2) to assure uniform concentration of the toner mixture and (3) to triboelectrically charge the developer mixture.

Adjacently offset rows of V-shaped baffles successively divide and intermix the developer mixture. Angled lifting plates interposed between successive rows of baffles scoop and lift the mixture so as to triboelectrically charge the same.

8 Claims, 3 Drawing Sheets

PADDLE WHEEL CROSS-MIXER

BACKGROUND OF INVENTION

The present invention relates to a mixer for use in the development housing of a photocopying machine, serving to lift, and mix the developer mixture, and to level the concentration of the mixture with a single element.

It is well known in the prior art that electrophotographic copying machines employ a two component brush developer to produce an image on an imaging surface by selectively developing toner particles from a mixture of carrier and toner. The quality of the resulting image depends upon the toner charge (tribo) and the toner concentration which is brought into contact with the imaging surface from the development unit.

Triboelectric charging of the toner is effected by mixing or tumbling the toner and the carrier within the development unit. Indeed, it is necessary to stir, mix, lift, and drop the toner/carrier mixture in order to create the triboelectric charge required for the development process. It is well known in the prior art to provide such a means in a development unit.

One consequence of image development onto the imaging surface is the removal of toner from the developer housing within the development unit thereby reducing the concentration of toner within the carrier. In order to maintain the toner concentration required for good and consistent image quality from the photocopying process, it is necessary to add toner to the development housing to replace that which is removed by the imaging surface. Toner, which is typically in powder form, is usually added uniformly along the entire length of the development unit—the length of the development unit usually being approximately equal to the maximum width of the copy media used by the photocopy apparatus. However, due to the spatial variations of the photocopied image (for example, most common applications may have more dark portions toward the center than around the edges of the image), toner is selectively removed at different rates across the width of the development housing. This selective removal of toner combined with the uniform addition of toner presents a problem in that the local toner concentration varies along the length of the developer system. This problem is particularly severe in long developer housings such as those used by engineering or architectural drawing copy machines.

The prior art has attempted to remedy this deficiency by various means such as the use of twin oppositely feeding augers, a paddle wheel in conjunction with one or more augers, and hollow paddle wheels containing screw shaped baffle systems. These prior art devices are deficient in that they are unnecessarily complicated, and therefore are failure prone. Furthermore, these devices may reduce the developer usable lifespan and may still not result in uniform or complete mixing over the full length of the development system.

It is therefore an object of this invention to provide an apparatus which will uniformly mix the developer mixture in a development system in a photocopier notwithstanding the non-uniform depletion of the toner in the developer system.

It is a further object of this invention to provide an apparatus which will agitate the developer mixture in a photocopier so as to triboelectrically charge the mixture.

It is a still further object of this invention to provide an apparatus which will not reduce the usable life of the developer mixture.

A still further object of this invention to provide the aforementioned objects with a simple, single unit.

SUMMARY OF INVENTION

The above and other beneficial objects and advantages are attained in accordance with the present invention by providing a long hollow cylindrical mixer which is rotatable about its longitudinal axis. The mixer includes multiple, angular lifting plates that lift and dump the developer mixture as the mixer rotates. These angular lifting plates are spaced to allow the developer mixture to flow between adjacent plates into the center regions of the assembly. The angular lifting plates scoop, lift and drop the developer mixture so as to triboelectrically charge the same.

A series of rows of alternately oriented flow directing baffles is interposed between the angular lifting plates in the center region. Each of these baffles is arranged to perform the function of dividing developer mixture into two parts and directing the material flow in laterally opposed directions as the mixer is rotated within the developer housing. By the use of a plurality of rows of baffles, the rotation of the mixer causes repeated cross-mixing to occur resulting in effective mixing of the developer and a uniform distribution of the toner therein.

DETAILED DESCRIPTION OF THE PREFERRED EMBODIMENT

Figure 1:
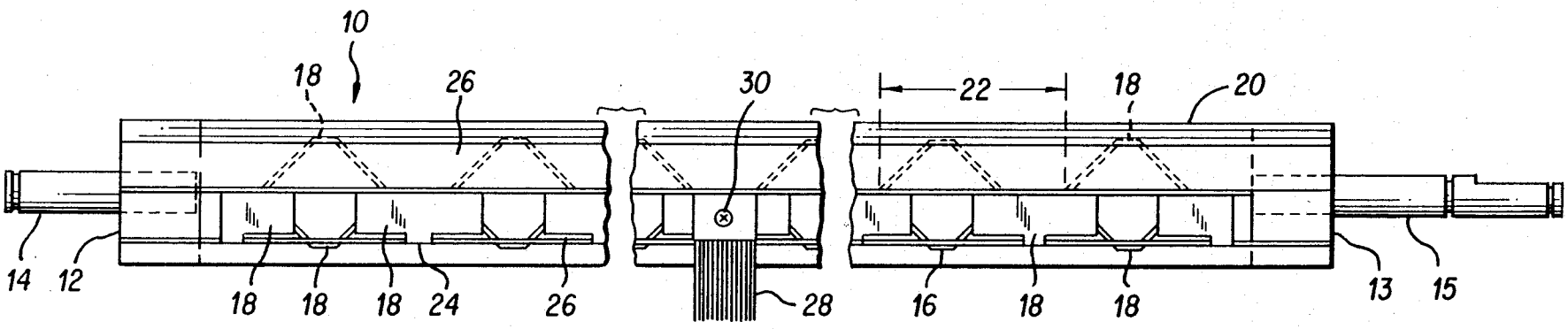
FIG. 1 discloses a front plan view of the present invention.

Referring now to the drawings in detail wherein like numerals indicate like elements throughout the several views, FIG. 1 discloses a front plan view of apparatus 10. Apparatus 10 is roughly cylindrical in shape with two ends 12,13 and axles 14,15 extending from ends 12,13 along the longitudinal axis of apparatus 10. A lower row 16 of baffles 18 extends along the bottom of apparatus 10. An upper row 20 of baffles 18 is shown in phantom along the top of apparatus 10. Baffles 18 have the cross-sectional shape of a truncated V. The spacing interval of these baffles will be referred to as a "mixing-unit length" 22. An intermediate row 24 of baffles 18 is shown on the front of apparatus 10. Further, a second intermediate row 32 (see FIG. 2) of baffles 18 is on the rear of apparatus 10, directly behind row 24 and positioned between rows 16 and 20. The position of baffles 18 in intermediate row 24 is offset by one half mixing-unit length 22 from the position of the baffles in rows 16 and 20. This offset is necessary in order to provide a thorough mixing of the developer mixture without any net lateral displacement of the mixture. This necessity for an offset is illustrated graphically in FIG. 3.

There are two kinds of flow directing baffles 18, each with identical mixing-unit lengths, but offset by one half mixing-unit length between adjacent rows 16, 20, 24, 32 (see FIG. 2 for element 32) of baffles 18. These types of flow directing baffles 18 will be referred to as "A" type and "B" type. To prevent any net lateral displacement of developer mixture, these flow directing baffles must occur in offset pairs. A minimum of one pair of rows (one "A" type and one "B" type) is required. More pairs, such as the two pairs shown in FIG. 1 may be advantageous to the efficacy of the design. In FIG. 1, rows 16 and 20 would be of one type chosen from "A" and "B", while row 24 and the rear row 32 (see FIG. 2) would be the other type.

Figure 2:
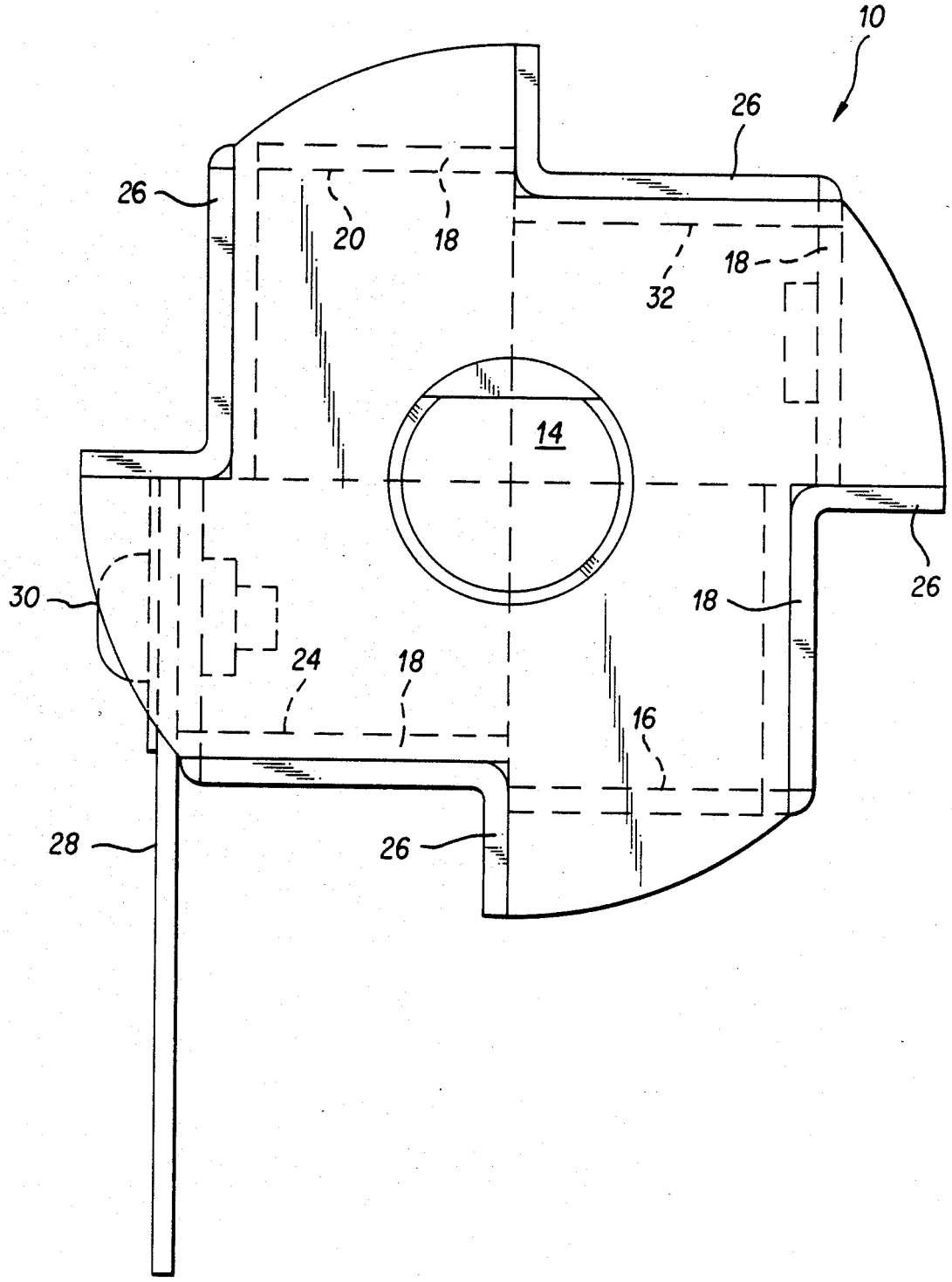
FIG. 2 discloses a side plan view of the present invention.

Angled lifting plates 26 are positioned between adjacent rows 16, 20, 24, 32 (see FIG. 2 for element 32). The purpose of angled lifting plates 26 is to scoop, lift and drop the developer mixture as apparatus 10 rotates thereby effecting the triboelectric charging of the developer mixture.

Apparatus 10 may optionally include a toner concentration sensor brush 28 attached to apparatus 10 by a screw 30 or similar means. This brush 28 is used to wipe or flick stagnant or accumulated developer material away from a toner concentration sensor (not shown) in the development housing as apparatus 10 rotates. This brush is described in more detail in the commonly assigned application, "Toner Concentration Sensor Wiper for Photocopying Machines" Ser. No. 306,991, filed Feb. 6,1989, now abandoned.

FIG. 2 discloses a side plan view of apparatus 10. There are a total of four lifting plates 26, positioned between rows 16, 20, 24, 32 of flow directing baffles 18. Mixing plates 26 have an outwardly pointing L-shaped cross section so as to provide a scooping means used for the triboelectric charging of the developer mixture as apparatus 10 rotates.

Figure 3:
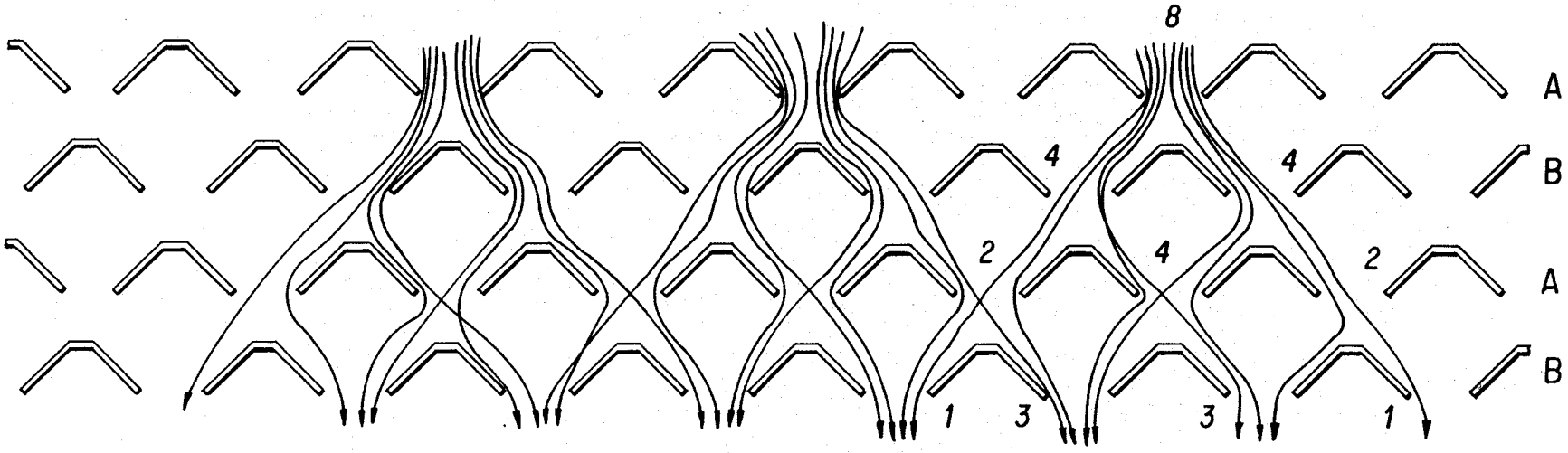
FIG. 3 illustrates how the present device uses a series of baffles to effect thorough mixing.

FIG. 3 illustrates the cross-mixing function of the flow directing baffles 18. The four rows 16, 20, 24, 32 of baffles 18 are shown in a linear rather than cylindrical shape. The alternating of rows of the "A" and "B" types of baffles 18 with an offset of one-half mixing-unit length 22 between adjacent rows is shown.

The baffles 18 are arranged to perform the function of dividing developer mixture into two parts and directing the material flow in opposite longitudinal directions as the apparatus 10 is turned within the developer housing (not shown). This takes the mixture in one mixing-unit length and deposits half of it in each of the two adjacent mixing-units located at the next rotational position of the device. These two rotationally disposed mixing-units are laterally displace by on half of a mixing-unit from the mixing-unit that supplied the developer material. This action is repeated along the entire length of the device with multiple mixing-units. When the assembly rotates sufficiently far to bring yet another lifting plate 26 (see FIGS. 4*a* and 4*b*) into position, half of the developer from each of the previous two laterally adjacent mixing-units is directed into a centrally located mixing-unit while all of the remaining developer mixture from each of the two mixing-units is split into the two laterally adjacent mixing-units nearest to the central mixing-units, all three mixing-units being rotationally displaced from the previous two mixing-units. Therefore, developer mixture is intermixed thereby correcting non-uniformities in toner concentration without causing any net longitudinal displacement of toner. The rotational version of the apparatus 10 is achieved by wrapping the elements of FIG. 3 into a cylinder.

Figure 4B:
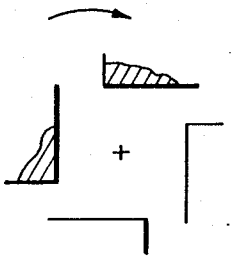
FIGS. 4*a* and 4*b* illustrate the operation of the angled lifting plates.
Figure 4A:
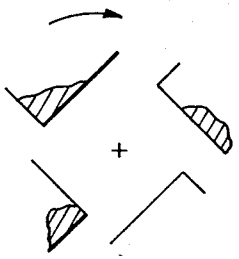

FIGS. 4*a* and 4*b* supplement FIG. 3 by illustrating the scooping and pouring of developer mixture by angled lifting plates 26. This occurs between the time that developer mixture engages adjacent rows 16, 20, 24, 32 of baffles 18 thereby further correcting non-uniformities in toner concentration in the developer.

Figure 5:
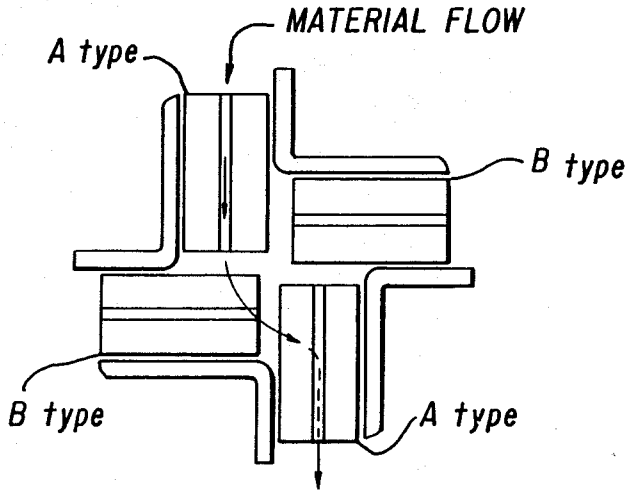
FIG. 5 discloses a side plan view of the present invention and illustrates the material flow during operation of the present invention.

FIG. 5 shows how rotation of the angled lifting plates 26 also scoops, lifts and drops the developer mixture thereby assuring proper triboelectric charge for the developer.

Thus, in accordance with the above, the aforementioned objects are effectively attained.

What is claimed is:

1. A mixer for developer mixture in a photocopier, comprising:

a rod shaped body with means for rotation about a longitudinal axis of said body;

at least a first and a second row of mixing baffles, said rows of mixing baffles being parallel to said longitudinal axis;

at least two lifting plates, said lifting plates being parallel to said longitudinal axis; and wherein said rows of mixing baffles are alternated with said lifting plates whereby said mixture after being lifted by one of said lifting plates flows over said first row of baffles and then directly over said second row of baffles.

2. The apparatus of claim 1 wherein said mixing baffles are of a V-shaped cross section opening in a direction of rotation of said body.

3. The apparatus of claim 2 wherein adjacent said rows of mixing baffles are offset by a distance equal to one half of a spacing interval of said baffles.

4. The apparatus of claim 3 wherein said lifting plates are of an L-shaped cross section opening in a direction perpendicular to said longitudinal axis thereby providing scooping means and triboelectric charging means for the developer mixture.

5. The apparatus of claim 2 wherein the number of rows of said mixing baffles is equal to the number of said lifting plates.

6. The apparatus of claim 5 wherein the number of rows of said mixing baffles and the number of said lifting plates is equal to four.

7. The apparatus of claim 2 further including means mounted on said body for wiping a toner concentration sensor.

8. The apparatus of claim 2 wherein said V-shaped cross section of said mixing baffles is truncated.

* * * * *